US006942471B2

(12) United States Patent
Weisser

(10) Patent No.: US 6,942,471 B2
(45) Date of Patent: Sep. 13, 2005

(54) ELECTRIC FAN WITH STRAIN RELIEF CONNECTION

(75) Inventor: Norbert Weisser, Niedereschach-Kappel (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 255 days.

(21) Appl. No.: 10/248,449

(22) Filed: Jan. 21, 2003

(65) Prior Publication Data

US 2004/0096325 A1 May 20, 2004

(30) Foreign Application Priority Data

Nov. 15, 2002 (DE) ..... 102 53 227

(51) Int. Cl.[7] ..... F04B 17/00; F04B 39/00

(52) U.S. Cl. ..... 417/423.1; 417/423.14; 417/423.15; 417/572

(58) Field of Search ..... 417/423.1, 423.14, 417/423.15, 313, 572, 360, 423.3; 361/695

(56) References Cited

U.S. PATENT DOCUMENTS

| | | | | | |
|---|---|---|---|---|---|
| 3,304,625 | A | * | 2/1967 | Gesmar et al. | 34/99 |
| 4,549,858 | A | | 10/1985 | Vettori et al. | 417/353 |
| 5,699,854 | A | | 12/1997 | Hong | 165/121 |
| 5,984,648 | A | * | 11/1999 | Stopyra et al. | 417/423.14 |
| 5,988,995 | A | * | 11/1999 | Hong | 417/423.14 |
| 6,000,919 | A | * | 12/1999 | Hsieh | 417/423.15 |
| 6,174,145 | B1 | * | 1/2001 | Taniguchi | 417/423.14 |
| 6,315,031 | B1 | * | 11/2001 | Miyahara et al. | 165/80.3 |
| 6,438,988 | B1 | | 8/2002 | Paskey | 62/353 |
| 2003/0077175 | A1 | * | 4/2003 | Marlander et al. | 416/203 |

FOREIGN PATENT DOCUMENTS

| | | |
|---|---|---|
| DE | 298 19 962 | 4/2000 |
| GB | 786454 | 11/1957 |
| GB | 2 329 423 | 3/1999 |

* cited by examiner

*Primary Examiner*—Timothy S. Thorpe
*Assistant Examiner*—Timothy P. Solak
(74) *Attorney, Agent, or Firm*—Gudrun E. Huckett

(57) ABSTRACT

A fan has a hub and a fan housing connected to the hub. The fan housing delimits an air passage of the fan outwardly. A fan wheel is connected to the hub and rotatably arranged in the air passage. A motor is arranged on the hub for driving the fan wheel. An electrical connection with at least one flexible line is connected to the motor and extends from the motor to the fan housing. A recess is provided within the fan housing and the flexible line extends from the motor to the recess. A holding member locks in place in the recess and deflects the flexible line at least at one deflection location about a predetermined minimum angle to thereby effect strain relief on the portion of the flexible line extending from the deflection location to the motor.

24 Claims, 8 Drawing Sheets

ELECTRIC FAN WITH STRAIN RELIEF CONNECTION

BACKGROUND OF INVENTION

1. Field of the Invention

The invention relates to a fan, in particular, a fan for electrical and electronic devices. The fan comprises a hub and a fan housing connected to the hub, wherein the fan housing delimits an air passage provided in the fan in the outward direction. The fan further comprises a fan wheel which is arranged rotatably in the air passage and a motor arranged on the hub for driving the fan wheel. An electrical connection is provided which extends from the motor to the fan housing and comprises at least one flexible line.

2. Description of the Related Art

A so-called strain relief must be provided for such flexible lines. Usually, the flexible lines are connected by soldering to a printed circuit board of the motor. This solder connection cannot be stressed permanently; it can be damaged or destroyed by mechanical strain or tension. Therefore, such a tension or strain must be stopped before it reaches the printed circuit board.

There are different possibilities of realizing such a strain relief. For example, the flexible line can be deflected by a certain angle at least at two locations so that the strain is absorbed in the area of these deflections and the rearward portion of the flexible line extending beyond the deflection locations to the motor remains free of strain. In this way, it is prevented that during transport, during mounting, and during operation of such a fan, a tensile force or strain will be transmitted via the flexible line into the interior of the fan and onto the contact locations or soldering locations or plug contacts and onto the printed circuit board of the motor.

In order to permanently ensure such a strain relief, it must be ensured that the flexible line is secured or fixed at this deflection location.

In the case of fans with plastic housings, such a strain relief is achieved, for example, in that the flexible line is threaded into stationary or fixed deflection means. When threading it into locking cams or narrow portions, the flexible line is secured therein permanently.

In the case of metal housings, the flexible line is threaded through an opening in the flange and then fixed by insertion of a holder and is permanently secured in this way. When a plug is connected to the flexible line, the plug must not be greater than the opening within the flange because otherwise it cannot be threaded through the opening. In such a case, mounting is carried out such that either the plug is connected to the flexible line only after the flexible line has been mounted or the flexible line provided with the plug is soldered to the printed circuit board of the motor only after mounting of the flexible line; both methods prolong the time required for assembly and increase costs for assembly.

SUMMARY OF INVENTION

It is therefore an object of the present invention to provide a fan configuration which eliminates the aforementioned problems.

In accordance with the present invention, this is achieved in that a cutout is provided within the fan housing to which the at least one flexible line extends and in which a holding member can be locked in place, wherein the holding member in the mounted state deflects the at least one flexible line at least at one location about a predetermined minimum angle and, in this way, effects strain relief on the part of the flexible line extending to the motor.

By employing a holding member which can be locked in place on the fan housing, it is possible to place the flexible line, before mounting of this holding member, in a simple way into a recess or cutout provided for this purpose, so that it must not be threaded, and to deflect the flexible line only upon mounting of the holding member. After mounting of the holding member, the flexible line—without plug—which has been fixed in place in this way, can only be removed from the strain relief device in that the holding member is removed or in that the flexible line is removed (unthreading) over its entire length out of these deflections. A flexible line which has a plug attached thereto can be removed from the strain relief device only in that the holding member is removed again from its locking position. It is thus very advantageous that the flexible line must not be threaded into the at least one deflection device; instead, it is deflected upon insertion and locking of the holding member and, in this way, the deflection required for strain relief is automatically provided in the locked position of the holding member.

Preferably, this is realized in that the holding member in the locked state deflects the flexible line at two deflection locations about a predetermined minimum angle in order to effect the strain relief. This provides a very safe strain relief without this requiring extra expenditure for assembly. Moreover, the present invention enables that the time for assembly becomes independent of the length of the flexible line and that even flexible lines provided at their end with a plug can be mounted entirely without problems.

A very advantageous embodiment is provided in that a support member for at least one flexible line is provided on the hub and supports the flexible line in the area of the air passage at least partially. Such a support member provides the advantage that the flexible line must not be threaded at this location but can be simply placed onto the support member; this simplifies mounting significantly.

DETAILED DESCRIPTION

Figure 1:
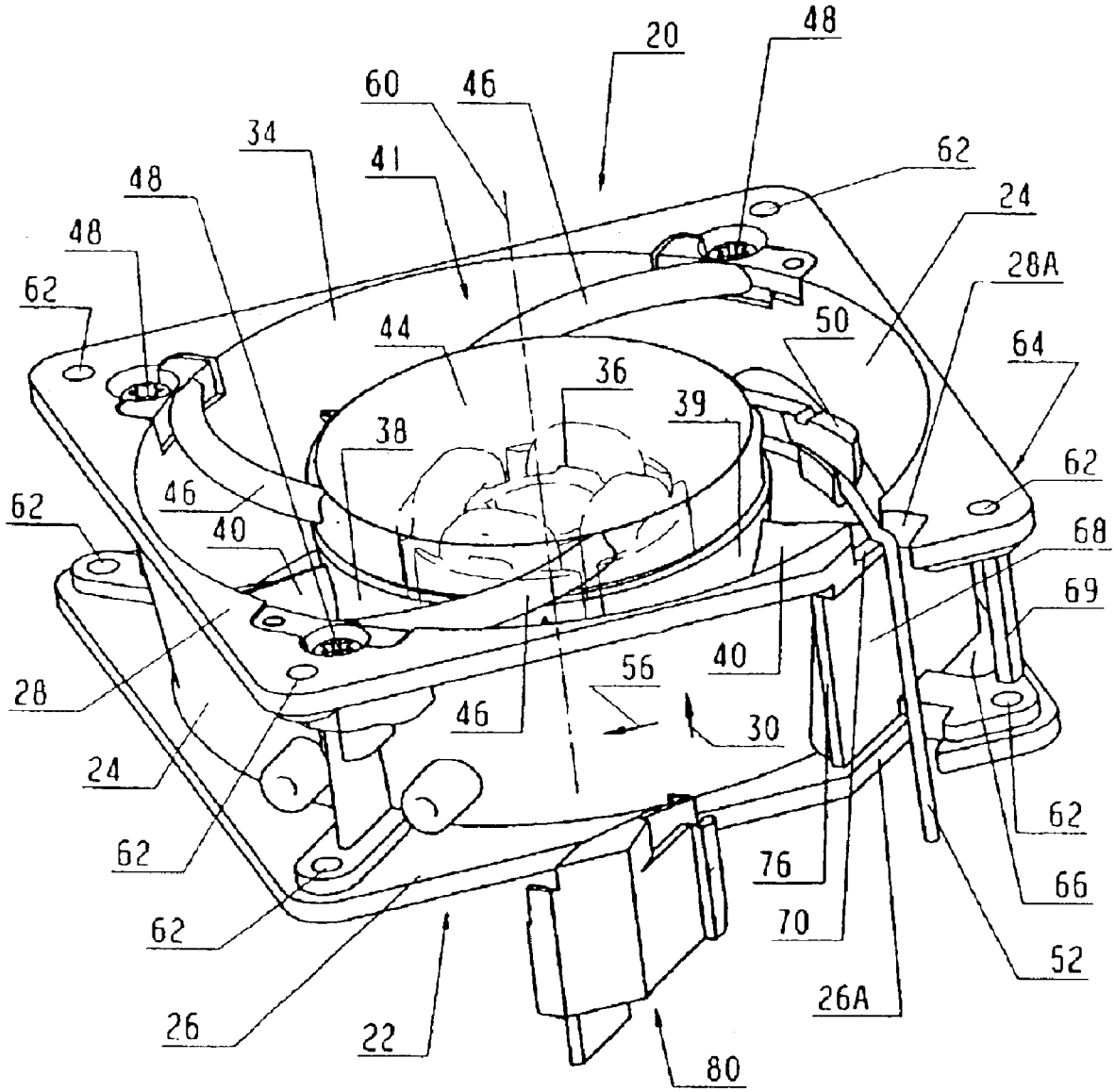
FIG. 1 is a perspective view of a preferred embodiment of the fan according to the invention before completion of assembly.

FIG. 1 shows in a perspective illustration a so-called device fan 20. It is illustrated in an exemplary fashion as a diagonal fan; this configuration has advantages for certain applications because a more beneficial characteristic line of the fan results: for example, when a filter is plugged and the flow rate dV/dt of the fan 20 drops, the generated pressure (static pressure) Δpf increases in a diagonal fan more strongly than in an axial fan. This provides a safety reserve for the user, in particular, when high pressure and high airflow are required.

Figure 2:
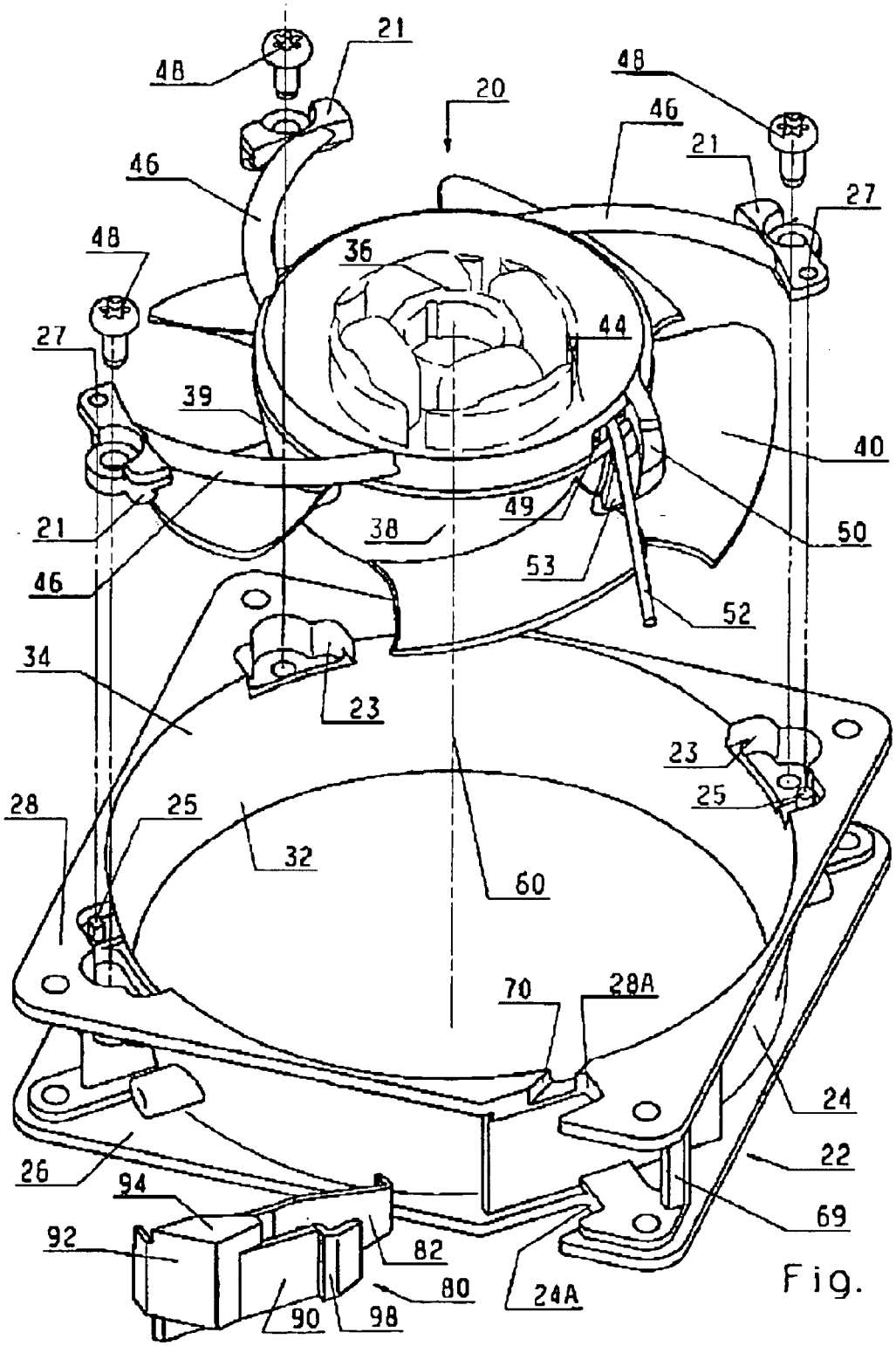
FIG. 2 is an exploded view of the fan of FIG. 1.

FIG. 2 shows the configuration of the fan 20 in an exploded view. The fan 20 has a fan housing 22 which is essentially a pipe-shaped section 24 of a truncated cone shape having at both end portions fastening flanges 26, 28. The flow direction 30 of the air is illustrated in FIG. 1. The intake side of the fan 20 is shown at 32 and the exit side at 34.

Figure 3:
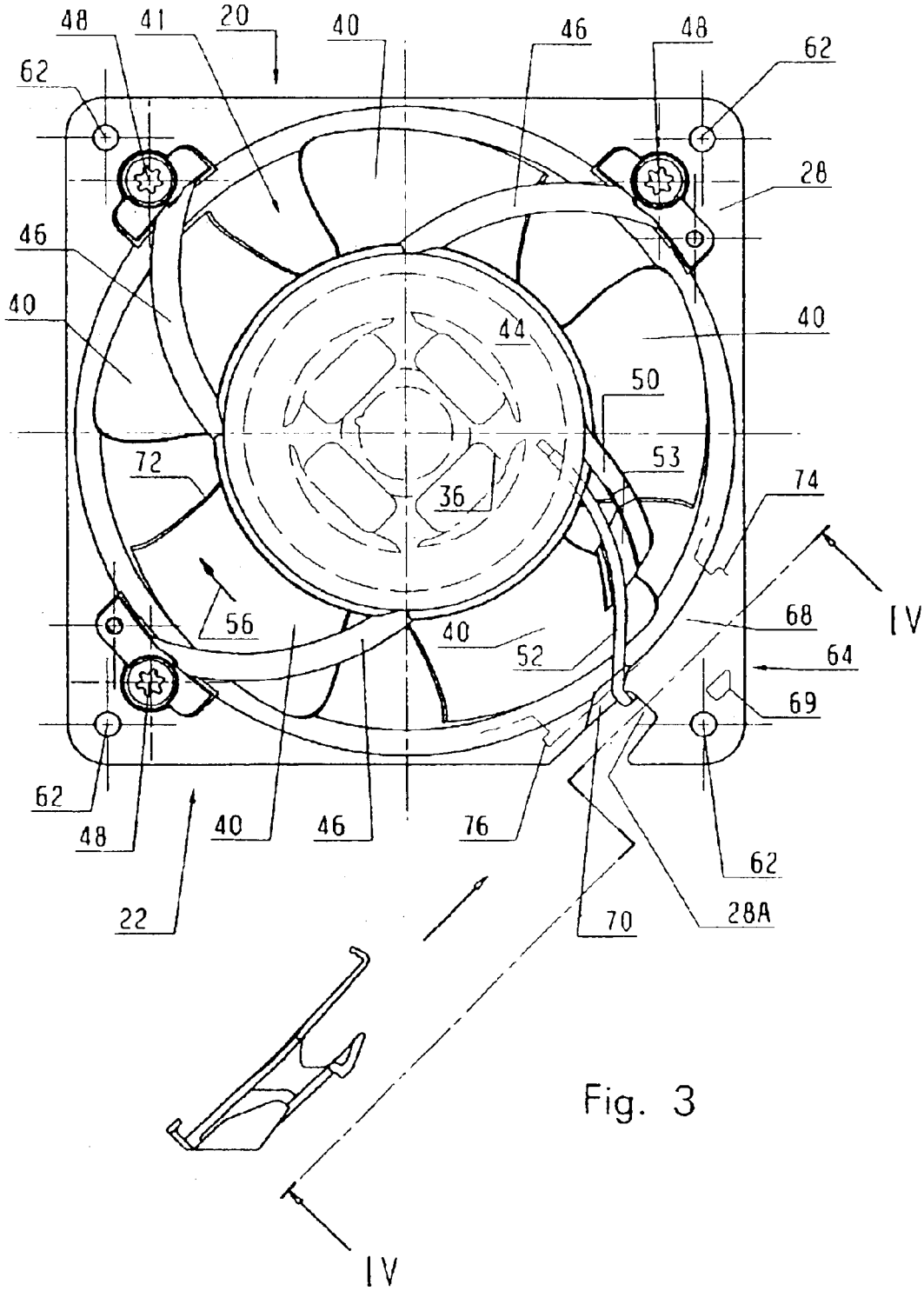
FIG. 3 is a plan view onto the air exit side of the fan of FIG. 1.

The fan 20 has a motor 36 whose stator in FIG. 1 through FIG. 3 is illustrated in dashed lines. It drives a fan wheel 38 with fan vanes 40. The motor 36 is preferably an electronically commutated two-phase external rotor motor in which the fan wheel 38 is mounted directly on the external rotor.

The shape of the fan vanes 40 is matched to the conical shape of the inner side of the pipe 24. The fan wheel 38 has a center part 39 having a truncated cone shape at its exterior side, as illustrated in FIG. 2. It forms together with the truncated cone shaped pipe 24 an air passage 41. The air passage has a smaller diameter at the intake side 32 than at the exit side 34. Also, the fan wheel 38 has a smaller diameter at the intake side 32. The diameter increases in the direction toward the exit side 34.

For mounting the motor 36, a fastening flange 44, which is also referred to in the following as a hub, is provided and connected by thin securing stays 46 to the fan housing 22. This is realized preferably by screw connections 48 indicated in FIG. 1 through FIG. 3. The outer or free ends of the stays 46 have widened portions 21 which fit in corresponding recesses 23 of the fan housing 22 (see FIGS. 1 through 3). A positive locking guide is provided: Two diametrically opposed recesses 23 have a guide member in the form of a centering pin 25, respectively, which locks positively in a corresponding complementary guide member (cutout) 27 of the correlated widened portion 21 and, in this way, centers the hub 44 exactly within the conical pipe 24. The screws 48 serve thus only for fastening but not for centering. This is a very advantageous type of connection, also with respect to automated manufacture.

Moreover, a shortened stay 50 is provided on the hub 44 whose function it is to support the flexible electric connecting line 52 of the motor 36. The electric line 52 can be configured, for example, as a multi-strand plastic-sheathed cable. As illustrated clearly in FIG. 2, the flexible line 52, coming from the motor 36 where it is, for example, soldered to a printed circuit board (not illustrated), passes through a lateral opening 49 of the hub 44, is then placed into a guide groove or support member 53 provided on the stay 50, and extends then farther outwardly to the fan housing 22 where a so-called strain relief for the cable 52 is provided which will be explained in the following.

The motor 36 is fixedly connected by non-illustrated securing pawls to the hub 44. The stays 46, 50 are preferably formed as unitary parts of the hub 44. In FIG. 1, the direction of rotation 56 of the illustrated fan 20 is shown.

The connecting line or cable 52 of the fan 20 usually contains several flexible insulated lines, preferably, so-called litz wires, each comprised of a plurality of thin wires which are embedded in an insulating material. In the home, such flexible lines or litz wires are used, for example, in the form of multi-strand plastic-sheathed cables for electrical connections of electric irons or television sets. The fan 20 requires two lines for supplying its operational voltage. In many cases, extra lines are provided, for example, for a tachometer generator signal or for an alarm signal. All of these flexible lines or cables must be attached quickly and primarily securely when mounting the fan 20; this will be explained in the following.

As shown in FIG. 1, the fan housing 22, viewed in the direction of the axis of rotation 60 (FIG. 2) of the motor 36 has a substantially rectangular, in particular, square, contour with four corners provided with bores 62 for attachment of the fan 20. On the corner 64, illustrated in FIGS. 1 through 3, at the forward end to the right, a recess 66 is provided. For this purpose, the pipe 24 is provided at its exterior with a flat widened portion 68 which extends preferably parallel to the axis of rotation 60 and transverse to the corner 64. At least one of the flanges 26, 28 has a cutout adjacent to this widened portion 68 (cutout 26A at the flange 26; cutout 28A at the flange 28). Preferably, the cutouts 26A, 28A are substantially aligned with one another so that the flexible line 52 can be guided through them in the axial direction, i.e., approximately parallel to the axis of rotation 60 (compare FIG. 1). In the area of the corner 64, the flanges 26, 28 are connected with one another by a connecting member 69 whose shape and position is illustrated clearly in FIGS. 1 through 3. Its function in the context of mounting the flexible line 52 will be explained in the following.

At the exit side 34 of the truncated cone-shaped pipe 24 a lateral recess 70 is provided which is positioned substantially on an imaginary extension of the shortened stay or support 50 so that the flexible line or cable 52, which is guided in the groove 53 of the stay 50, can be placed subsequently through the cutout 70 and through the cutouts 28A and 26A without having to be threaded anywhere. This type of guiding of the line 52 is clearly illustrated in FIGS. 1 through 3. The line 52 extends approximately parallel to the flat widened portion 68. This represents an intermediate step of assembly which will become apparent from the following description.

FIG. 3 shows a plan view onto the exit side of the fan 20. The five fan vanes 40 are clearly illustrated as well as their shape which is characteristic of a diagonal fan. The concave ends 72 of the vanes 40 are positioned on the intake side 32. Moreover, the shape of the three stays 46 is clearly shown as well as the connections 48 with the fan housing 22. Also shown is the shape of the shortened stay 50 and the support member or groove 53 provided thereon in which the at least one flexible line or cable 52 is inserted in the illustrated way. This groove 53 extends only across a portion of the air passage cross-section 41, for example, as illustrated, across one-third of its radial extension. Moreover, the flat widened portion 68 has a transition into a projection 74, illustrated in FIG. 3 to the right, where a locking action is possible. The left end has a transition into an analog projection 76 whose function will be explained in the following.

Figure 4:
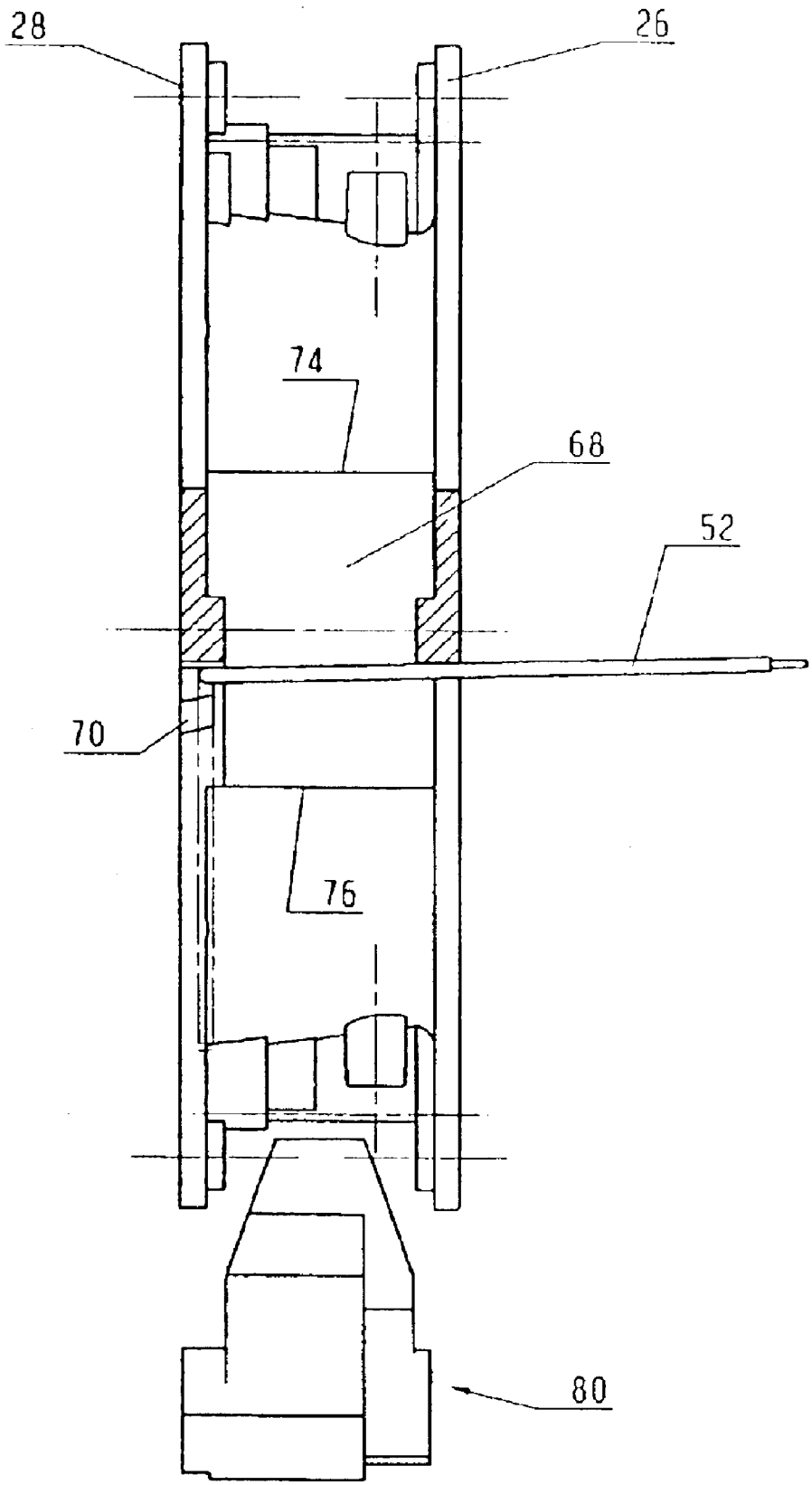
FIG. 4 is a section along the line IV—IV of FIG. 3.

As illustrated, the flexible line 52 extends from the motor 36 via the groove 53 and through the cutout 70 of the truncated cone-shaped pipe 24 to the two cutouts 28A, 26A of the flanges 28 and 26. This is illustrated also in FIG. 4 which shows a section of the indicated part of FIG. 3.

Figure 5:
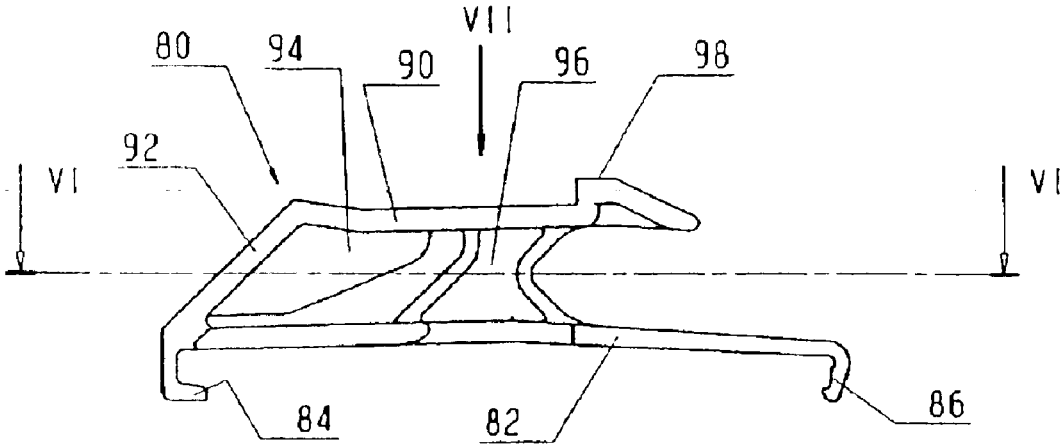
FIG. 5 is a side view of a lockable holding member, viewed in the direction of arrow V of FIG. 7.
Figure 6:
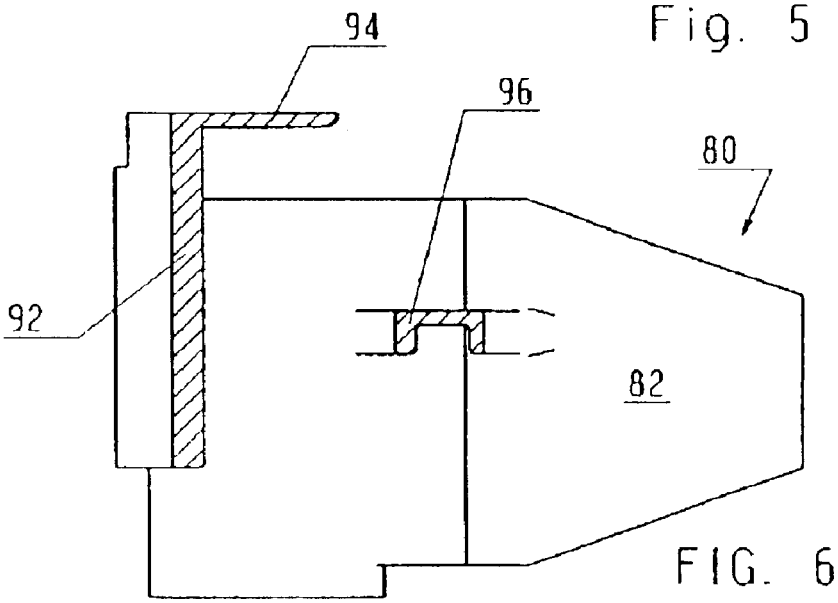
FIG. 6 is a section along the line VI—VI of FIG. 3.
Figure 7:
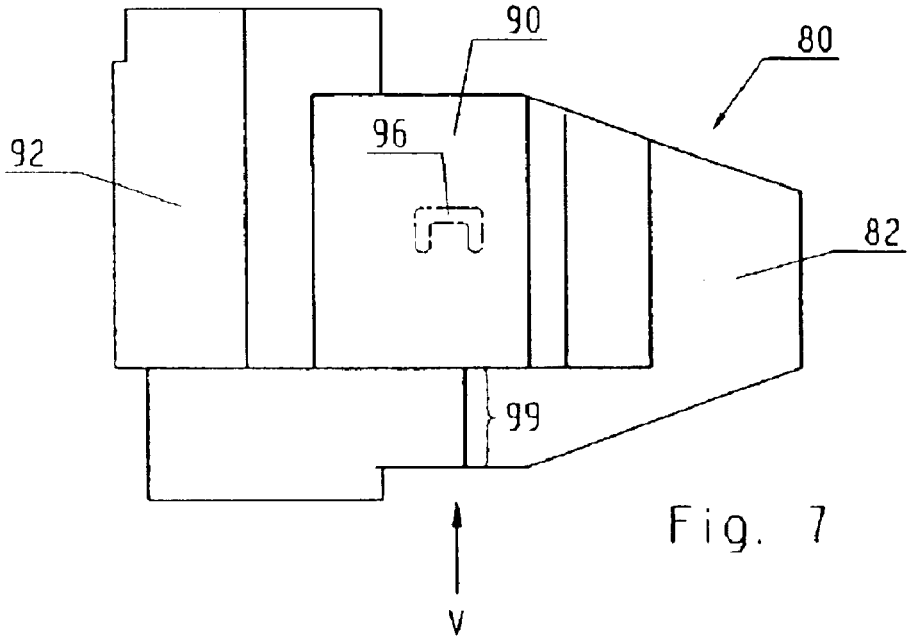
FIG. 7 is a plan view viewed in the direction of arrow VII of FIG. 5.

FIG. 5 shows a holding member 80 viewed in the direction of arrow V of FIG. 7, i.e., viewed in a side view. FIG. 6 shows a section viewed along the line VI—VI of FIG. 5, and FIG. 7 shows a plan view onto the holding member 80, viewed in the direction of arrow VII of FIG. 5. FIGS. 12 through 15 show the holding member 80 in different perspective views in order to facilitate understanding of its shape.

The holding member 80 has a substantially flat base part 82 which is illustrated in FIGS. 6 and 7 in a plan view and serves for locking the holding member 80 at the corner 64 of the fan 20 in the recess 66 provided thereat. For this purpose, it is provided at its underside to the left with a hook 84 which, according to FIG. 8, engages in the mounted state behind the projection 76 of the fan housing 22. To the right, the holding member 80 has a detachable springy locking hook 86 which, according to FIG. 8, can be locked on the projection 74 of the fan housing 22. In FIG. 9, the holding member 80 is thus moved from the left into the recess 66 to such an extent that it is secured on the projection 74, 76 in the way illustrated in FIGS. 8 and 9.

In FIG. 5, above the base part 82 a roof part 90 is provided which is connected with its left end via a slanted potion 92 with the base 82. The upper areas of the roof part 90 of FIGS. 6 and 7 are wider than the base part 82, and a limiting wall 94 is formed which extends perpendicularly to the base part 82 and whose shape and position can be seen clearly in FIGS. 5 and 6.

The roof part 90 is also connected at a location provided approximately at its center by means of a deflection member 96 to the base part 82. As illustrated in FIGS. 8 to 11, the deflection member 96 has the purpose of deflecting the flexible line 52 by a certain minimum angle after the holding member 80 has been inserted into the fan housing 22.

Figure 8:
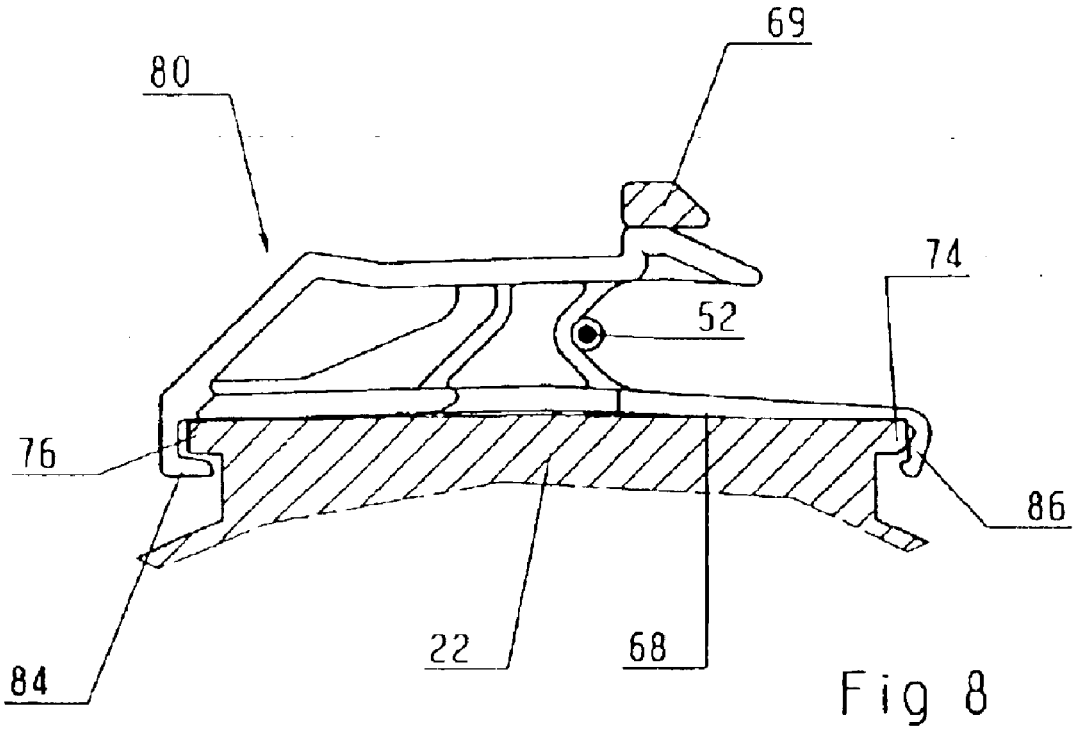
FIG. 8 is a schematic illustration of the holding member of FIG. 5 in the mounted state.
Figure 9:
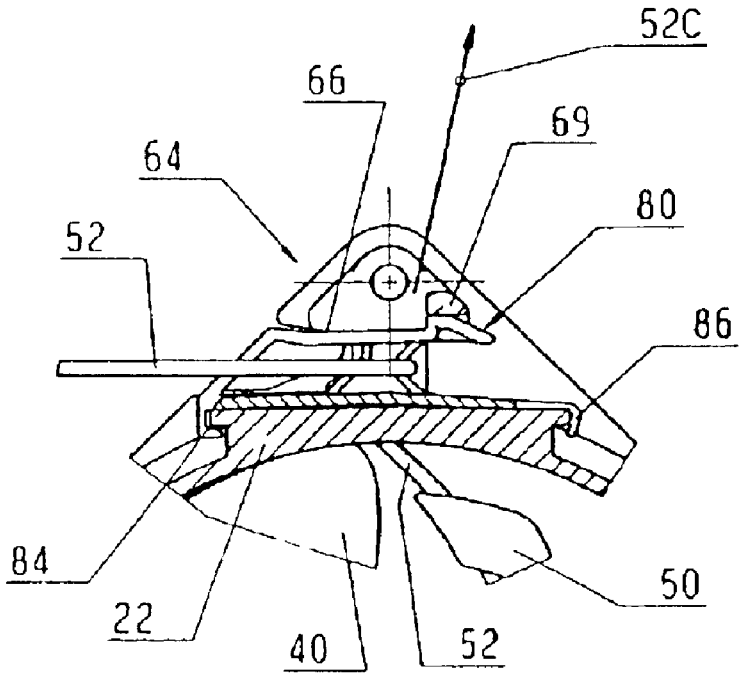
FIG. 9 is a section viewed along the line IX—IX of FIG. 11.

To the right of the deflection member 96, the roof part 90 has a raised section 98 which, according to FIGS. 8 and 9, rests in the mounted state with tension against the part 69 which prevents that the holding member 80 will be released when exposed to strain by becoming detached from the location 74. Detachment is possible however when moving by hand the holding member 80 to the right in FIG. 8 or 9 and when bending with the other hand the springy locking hook 86 in the upward direction and subsequently pulling or pushing by hand the holding member 80 out of the recess 66 to the left. The holding member 80 is preferably made of a springy plastic material.

As illustrated in FIG. 7, the roof part 90 covers only a portion of the base part 82 in the lower area. The flexible line 52 can be guided through this free area 99. Should this not be desired, the area 99 can also be covered completely by the roof part 90.

FIG. 9 shows the holding member 80 in the mounted state in the recess 66 at the corner 64 of the fan housing 22. After mounting, the holding member 80 is locked in this position but can be unlocked by lifting the springy locking member 86 and can be moved or pulled out of the recess 66 to the left.

Figure 10:
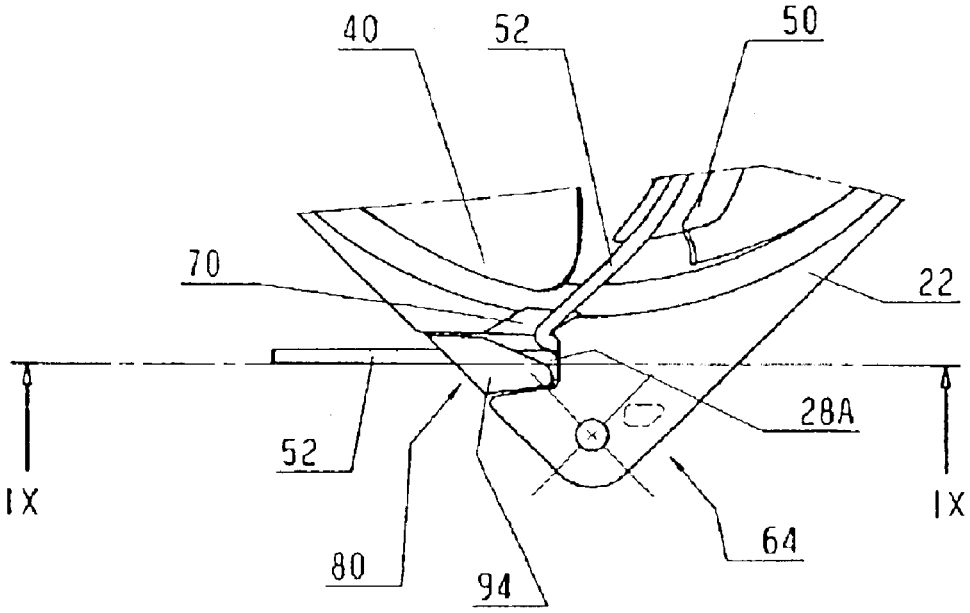
FIG. 10 is a plan view onto a corner of the fan in which a holding member is mounted.

FIG. 10 shows the same corner 64 of the fan housing 22 but in a plan view and not in a sectional view. The flexible line 52 is shown which is guided via the stay or support 50 to the recess 70. The lateral cutout 28A of the fan housing 22 is substantially closed by the section 94 of the holding member 80 so that a guide opening is formed for the flexible line 52; this is illustrated clearly in FIG. 11.

By means of the deflection member 96, the flexible line 52 is moved in FIG. 111 to the right upon insertion of the holding member 80 so that it is deflected once at a first deflection location 106 where it exits the cutout 70. Moreover, the flexible line 52 is deflected by the deflection member 96 at a second deflection location 108 by an angle which, depending on the application, can be approximately between 60 and 110 degrees. When the flexible line 52 is guided in direction 52A out of the fan 20, the deflection angle at the second deflection location 108 is approximately 60 degrees; when the flexible line 52 is guided in the direction 52B out of the fan 20, i.e., through the cutout 26A, the deflection angle at the location 108 is greater than 90 degrees. Finally, the flexible line 52 can also be guided in the direction 52C illustrated in FIG. 9; in this embodiment it rests against the part 69 of the fan housing 22. The line 52 then extends through the free space 99 illustrated in FIG. 7. When this configuration is to be excluded, the free space 99 is covered completely by the roof part 90 in that this roof part 80 is shaped correspondingly wider.

Figure 11:
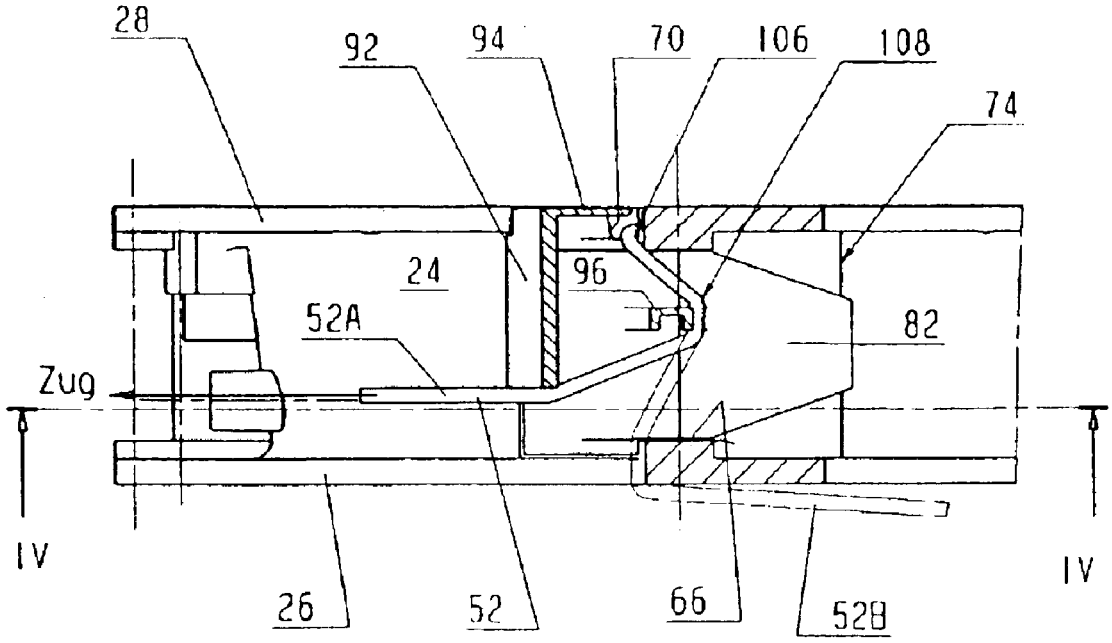
FIG. 11 is a section (analog to FIG. 4) viewed along the line XI—XI of FIG. 10 but with the holding member mounted and the flexible line mounted.
Figure 12:
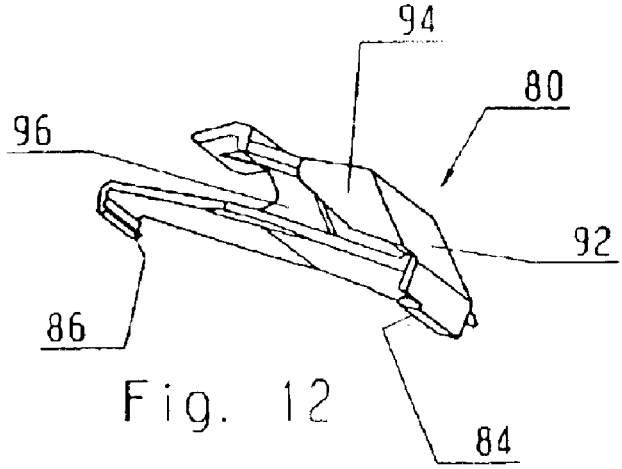
FIG. 12 is a perspective illustration of the holding member viewed in a first direction.
Figure 13:
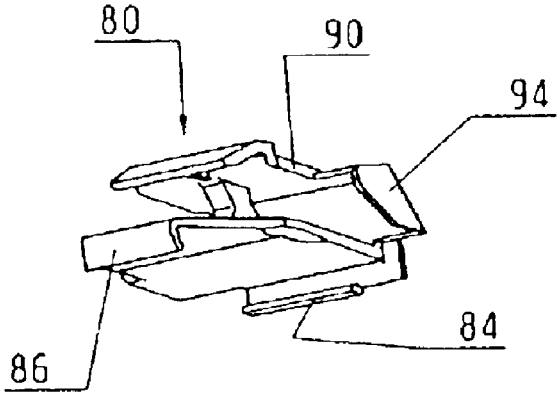
FIG. 13 is a perspective illustration of the holding member viewed in a second direction.
Figure 14:
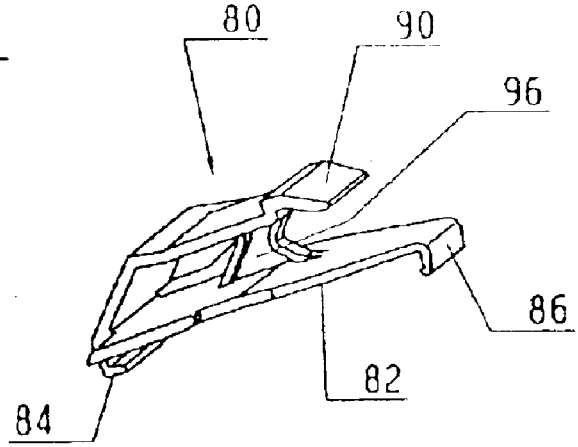
FIG. 14 is a perspective illustration of the holding member viewed in a third direction.
Figure 15:
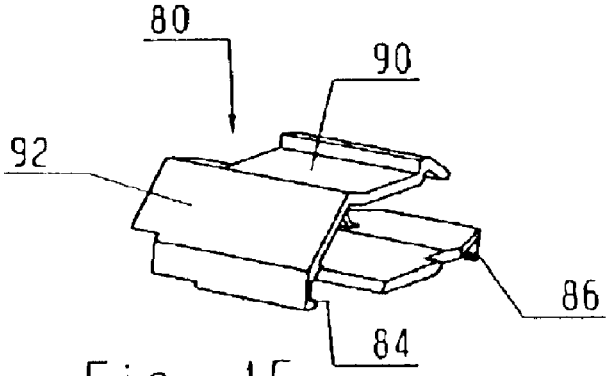
FIG. 15 is a perspective illustration of the holding member viewed in a fourth direction.

Because of the two deflection locations 106, 108 of FIG. 11, the required strain relief is realized in any case on that side of the flexible line 52 which extends to the motor 36. Mounting is very easy, i.e., the flexible line 52 is inserted into the fan 20 as illustrated in FIG. 1 and then the holding member 80 is pushed into the recess 66 and locked therein. In this way, the two deflection locations 106,108 (FIG. 11) are automatically realized so that the desired strain relief is provided. Such an assembly is thus independent of whether a plug is connected to the line 52 or not. As an alternative, a plug can be attached directly in or on the holding member 80 or the holding member 80 itself can be configured as a plug and this plug can be inserted into the recess 66 and locked therein.

Advantages of the invention result primarily from the following features: Before mounting the holding member 80, at least one flexible line 52 can be inserted directly into the corresponding openings of the fan 20, i.e., it is no longer required to thread the line 52; the line 52 is deflected at the locations 106,108 once the holding member 80 is mounted.

After mounting, the flexible line 52, inasmuch as no plug is connected thereto, can be removed only by unthreading its entire free length or by demounting the holding member 80 from the strain relief.

A flexible line 52 to which a plug is attached can be removed only by releasing the holding member 80 from the strain relief.

The insertion and locking of the holding member 80 deflects the at least one flexible line 52 at the same time at two locations 106,108 (FIG. 11) so that in the end position of the holding member 80 automatically the required number and type of deflections required for strain relief are provided.

Inasmuch as several flexible lines 52 are used, a significant labor simplification is realized by the two cutouts 26A, 28A into which these lines 52 are introduced before mounting as shown in FIG. 1. When the lines 52 have been inserted, subsequently the holding member 80 can be inserted and locked. However, the invention can be realized, for example, without the cutout 26A because strain relief can be obtained also by deflection in this case.

The time for assembly is independent of the length of the flexible line(s) 52.

Flexible lines having a plug at their free end can be mounted without problems in the described way.

By means of the stay 69 provided on the housing 22, unthreading of the flexible line 52 in the locked state of the holding member 80 is not possible or possible only with difficulties.

Threading of the flexible line 52 in stationary deflection means on the housing is eliminated by the invention so that the time for assembly is shortened correspondingly.

In place of the illustrated individual flexible lines 52, the invention can also be employed in the same way with several flexible lines or lines which are enclosed in an insulating hose and require a strain relief.

Instead of the holding member 80 it is also possible to provide a plug connector.

Inasmuch as a tensile force acts on the flexible line 52 in a direction perpendicularly to the insertion direction, it is not received by the holding member 80 but by part 69 of the housing 22; compare line 52C in FIG. 9.

The part 69 stabilizes in the area of the corner 64 the two flange parts 26 and 28 relative to one another. This is advantageous when attaching the fan 20 by means of its flanges 26, 28, for example, in the case of a screw connection with screws passing through. In the area of the other corners analog reinforcements can be provided, as illustrated clearly in FIG. 1.

The invention is particularly advantageous in combination with a diagonal fan but can also be used in axial fans. Naturally, within the context of the invention several variations are possible. For example, the shortened stay or support 50 can also be of such a length that it is connected to the corner 64 of the fan housing 22, for which purpose a somewhat different shape than that of the stays 46 must be provided. Also, the invention can be used in the same way where lines are used which are relatively rigid, i.e., no litz wires, for connecting a fan. These and other modifications are within the scope of the invention.

While specific embodiments of the invention have been shown and described in detail to illustrate the inventive principles, it will be understood that the invention may be embodied otherwise without departing from such principles.

What is claimed is:

1. A fan comprising:

a hub (44);

a fan housing (22) connected to the hub (44), wherein the fan housing (22) delimits an air passage (41) of the fan in an outward direction;

a fan wheel (38) connected to the hub (44) and rotatably arranged in the air passage (41);

a motor (36) arranged on the hub (44) for driving the fan wheel (38);

an electrical connection comprising at least one flexible line (52) and connected to the motor (36) and extending from the motor (36) to the fan housing (22);

a recess (66) provided within the fan housing (22), wherein the at least one flexible line (52) extends from the motor (36) to the recess (66);

a holding member (80) configured to be locked in place in the recess (66) in a mounted state;

wherein the holding member (80) in the mounted state in the recess (66) deflects the at least one flexible line (52) at two deflection locations (106, 108) about a predetermined minimum angle and effects strain relief on the portion of the at least one flexible line (52) extending from the deflection location to the motor (36).

2. The fan according to claim 1, wherein the fan housing (22) comprises a pipe-shaped section (24) radially outwardly delimiting the air passage (41), wherein the pipe-shaped section (24) connects an intake side (32) and an exit side (34) of the fan and has a truncated cone shape over most of an axial extension of the pipe-shaped section (24), wherein the pipe-shaped section (24) has a greater diameter at the exit side (34) than at the intake side (32).

3. The fan according to claim 2, wherein the hub (44) is attached to the fan housing (22) near the exit side (34).

4. The fan according to claim 2, wherein the hub (44) has an exterior side and comprises stays (46) connected to the exterior side and provided with outer ends (21), wherein at least some of the stays (46) are connected with the outer ends (21) to the fan housing (22).

5. The fan according to claim 4, wherein at least one of the stays (50) has a support member (53) configured to support the at least one flexible line (52) at least partially within the air passage (41).

6. The fan according to claim 4, wherein at least one of the stays (46) has a first guide member (27) and the fan housing (22) has a complementary second guide member (25), wherein the first and second guide members (25, 27) provide a positive-locking guide configured to define a position of the stay (46) relative to the fan housing (22).

7. The fan according to claim 6, wherein two of the stays (46), positioned diametrically opposed to one another, are provided with the first guide member (27), respectively, and the fan housing (22) has two of the second guide members (25).

8. The fan according to claim 1, wherein the at least one flexible line comprises at least one insulated litz wire.

9. The fan according to claim 1, wherein the at least one flexible line comprises several flexible litz wires.

10. The fan according to claim 9, wherein the at least one flexible line further comprises an insulating hose and the flexible litz wires are arranged in the insulating hose.

11. The fan according to claim 1, wherein the at least one flexible line (52) is a multi-strand plastic-sheathed cable.

12. The fan according to claim 1, wherein:

the fan housing (22) comprises a pipe-shaped section (24) radially outwardly delimiting the air passage (41), wherein the pipe-shaped section (24) connects an intake side (32) and an exit side (34) of the fan and has a truncated cone shape over most of an axial extension of the pipe-shaped section (24), wherein the pipe-shaped section (24) has a greater cross-section at the exit side (34) than at the intake side (32);

the fan wheel (38) has vanes (40) having a peripheral shape matching the truncated cone shape of the pipe-shaped section (24);

the hub (44) comprises stays (46) connected to an exterior side of the hub (44) and projecting radially outwardly away from the hub (44), wherein the stays (46) are arranged near the exit side (34) and are provided with outer ends (21) detachably connected to the fan housing (22) in order to enable mounting of the fan wheel (38) in the air passage (41) through the exit side (34).

13. The fan according to claim 12, wherein a greatest diameter of the vanes (40) is greater than a smallest diameter of the air passage (41).

14. The fan according to claim 12, wherein the fan wheel (38) has a center part (39) and the vanes (40) have a radially inner end, respectively, connected to the center part (39), wherein the center part (39) has a diameter increasing in a direction toward the exit side (34) at least within portions of the center part (39).

15. The fan according to claim 14, wherein the center part (39) has an exterior having a truncated cone shape.

16. The fan according to claim 12, wherein at least one of the stays (46) has on the outer end (21) a first guide member (27) and the fan housing (22) has a complementary second guide member (25), wherein the first and second guide members (25, 27) provide a positive-locking guide configured to define a position of the stay (46) relative to the fan housing (22).

17. The fan according to claim 16, wherein two of the stays (46), positioned diametrically opposed to one another, are provided with the first guide member (27), respectively, and the fan housing (22) has two of the second guide members (25).

18. The fan according to claim 1, wherein the holding member has means for locking the holding member in the recess.

19. A fan comprising:

a hub (44);

a fan housing (22) connected to the hub (44), wherein the fan housing (22) delimits an air passage (41) of the fan in an outward direction;

a fan wheel (38) connected to the hub (44) and rotatably arranged in the air passage (41);

a motor (36) arranged on the hub (44) for driving the fan wheel (38);

an electrical connection comprising at least one flexible line (52) and connected to the motor 36 and extending from the motor (36) to the fan housing (22);

a recess (66) provided within the fan housing (22), wherein the at least one flexible line (52) extends from the motor (36) to the recess (66);

a holding member (80) configured to be locked in place in the recess (66);

wherein the holding member (80) in a mounted state in the recess (66) deflects the at least one flexible line (52) at least at one deflection location (106, 108) about a predetermined minimum angle and effects strain relief on the portion of the at least one flexible line (52) extending from the deflection location to the motor (36);

a support member (53) connected to the hub (44) and configured to support the at least one flexible line (52) at least partially within the air passage (41).

20. The fan according to claim 19, wherein the fan housing (22), viewed in a direction of an axis of rotation (60) of the motor (36), has a rectangular or square contour with corners (64), wherein the recess (66) is located at one of the corners (64).

21. The fan according to claim 19, wherein the support member (50) is arranged between the hub (44) and the one corners 64) provided with the recess (66).

22. The fan according to claim 19, wherein the recess (66) extends substantially transversely to the one corner (64).

23. The fan according to claim 19, wherein the fan housing (22) comprises a pipe-shaped section (24) radially outwardly delimiting the air passage (41), wherein the pipe-shaped section (24) has at least one end portion provided with a flange (26, 28) extending substantially perpendicularly to an axis of rotation (60) of the motor (36), wherein the flange (26, 28) has a cutout (26A, 28A) in an area of the recess (66) configured to receive the at least one flexible line (52), wherein the cutout (26A, 28A) and the holding member (80) together deflect the at least one flexible line (52).

24. The fan according to claim 23, wherein the cutout (28A) comprises a lateral cutout (70) within the at least one end portion extending radially through the pipe-shaped section (24).

* * * * *